US006755922B2

(12) United States Patent
Nakamura et al.

(10) Patent No.: US 6,755,922 B2
(45) Date of Patent: Jun. 29, 2004

(54) HIGH STRENGTH MG BASED ALLOY AND MG BASED CASTING ALLOY AND ARTICLE MADE OF THE ALLOY

(75) Inventors: Kiyomi Nakamura, Hitachi (JP); Teruo Hirane, Hitachinaka (JP); Toshio Uchida, Hitachinaka (JP); Teruyoshi Abe, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/727,535

(22) Filed: Dec. 4, 2000

(65) Prior Publication Data

US 2001/0055539 A1 Dec. 27, 2001

(30) Foreign Application Priority Data

Dec. 3, 1999 (JP) ..... 11-344210

(51) Int. Cl.[7] ..... C22C 23/00
(52) U.S. Cl. ..... 148/420; 148/272; 420/409
(58) Field of Search ..... 148/420, 272, 148/424; 420/409, 407, 408

(56) References Cited

U.S. PATENT DOCUMENTS

| | | | | |
|---|---|---|---|---|
| 1,680,262 A | | 8/1928 | Gann | |
| 1,942,041 A | | 1/1934 | Wood | |
| 2,000,115 A | | 5/1935 | Wood | |
| 3,653,880 A | * | 4/1972 | Gillesen | |
| 4,332,864 A | * | 6/1982 | King et al. | 429/3 |
| 4,675,157 A | | 6/1987 | Das et al. | |
| 5,964,965 A | * | 10/1999 | Schulz et al. | 148/420 |

FOREIGN PATENT DOCUMENTS

| | | | |
|---|---|---|---|
| DE | 1259578 | * | 1/1968 |
| DE | 1301914 | * | 8/1969 |
| DE | 1934617 | * | 7/1974 |
| DE | 1934617 | | 12/1993 |
| EP | 0575796 | | 12/1993 |
| GB | 265299 | | 2/1927 |
| GB | 596102 | | 12/1947 |
| GB | 690786 | | 4/1953 |
| GB | 1113304 | | 5/1968 |
| GB | 1291553 | * | 10/1972 |
| GB | 2058837 | | 4/1981 |
| JP | 2047238 | * | 2/1990 |
| NO | 20675 | * | 11/1968 |
| SU | 241679 | * | 4/1969 |
| SU | 447452 | | 10/1974 |

OTHER PUBLICATIONS

Drits, M.E.; Gur'ev, I.I.; Sviderskaya , Z.A.; Elkin, F.M.; Trokhova, V.F., Structure and properties of semifinished products made of ultralight alloys, Tekhol. Legk. Splavov. Nauch.—Tekh. Byul. Vses. Inst. Legk. Splavov (1971) , No. 2, 9–16 (provided abstract only), 1971.

Drits, M.E.; Sviderskaya, Z.A.; Trokhova, V.F., Ultralight magnesium–lithium alloys based on the—alpha.t.beta. two–phase region, strukt. svoustva Legk. Splavov (1971) 118–22. (provided abstract only).

* cited by examiner

*Primary Examiner*—Sikyin Ip
(74) *Attorney, Agent, or Firm*—Antonelli, Terry, Stout & Kraus, LLP

(57) ABSTRACT

An object of the present invention is to provide a high strength Mg based alloy and a Mg based casting alloy having a good fluidity and a good mechanical property, and a molded article using the alloy. A high strength Mg based alloy, which contains, by weight, 12 to 20% of Al, 0.1 to 10% of Zn; 0.1 to 15% of Sn; and 0.05 to 1.5% of Mn.

9 Claims, 14 Drawing Sheets

HIGH STRENGTH MG BASED ALLOY AND MG BASED CASTING ALLOY AND ARTICLE MADE OF THE ALLOY

BACKGROUND OF THE INVENTION

1. Field of the Invention

The present invention relates to a novel Mg based alloy and a novel Mg casting alloy capable of mass producing OA parts, car parts, electric appliance parts and so on through die casting, injection molding or the like, and relates to articles mold-cast using the alloy.

2. Description of the Prior Art

The casting Mg alloys practically used in present time are as follows:

(1) AZ, AM alloys (Mg—Al—(Zn)—Mn system, for example, ASTM: AZ91D);

(2) AS alloy (Mg—Al—Si—Mn system, for example, ASTM: AS41); and (3) AE, QE, WE alloys (an alloy group containing one or more kinds of REM, Ag, Y).

The alloy (1) is most commonly used as the die casting and the injection molding Mg alloy, and particularly the AZ91D is good in die-castability and in corrosion resistance and widely applied to car parts and electric appliance parts. The alloys (2), (3) are alloys improving the mechanical properties such as the creep property and the high temperature strength. As the prior art in regard to these alloys, various kinds of alloys are disclosed in the following patent gazettes.

For example, Japanese Patent Application Laid-Open No.6-330216 discloses an Mg based alloy containing Ca, Si, Al, Zn and Mn, Japanese Patent Application Laid-Open No.9-104942 discloses an Mg based alloy containing 5 to 10 of Al, 0.2 to 1 of Si and 0.05 to 0.5 of Cu, and Japanese Patent Application Laid-Open No.10-147830 discloses an Mg based alloy containing 1 to 6 of Gd and 6 to 12 of Y.

With growing needs of thin thickness and high precision of parts in order to reduce in weight and size of potable devices, high fluidity alloys have been required. The alloy (1) of AZ91D described above is comparatively high in the fluidity, but the molding yield in injection molding is not always sufficiently high.

The alloy groups (2), (3) are prior to AZ91D in the mechanical properties such as creep property, strength at high temperature. However, because of the bad fluidity, the alloy groups (2), (3) are apt to cause casting cracks in the molding method of high speed cooling such as the injection molding method and are bad in castability.

The fluidity may be improved by raising the temperature of molten alloy. However, raising of the molten alloy temperature has problems in oxidation of the molten alloy and in shortening of durable lifetime of the production machines. Therefore, it is necessary to improve the fluidity by the other method.

It is known that the solidification structure of AZ91D becomes dendritic when it is cooled in a comparatively slow speed such as at ingot casting. As described above, the alloy is designed by placing special emphasis on the molten fluidity, and in regard to the properties after solidification, the alloy is designed so that the various kinds of properties such as the mechanical properties are optimized on the premise that the structure of AZ91D becomes dendritic.

However, in the cases of die casting and injection molding to which the alloy is widely applied, it is known that the structure after solidification becomes the cellular structure not the dendritic structure because the cooling rate is very fast. Therefore, it is required to change the designing method of the conventional alloying composition.

SUMMARY OF THE INVENTION

An object of the present invention is to provide a high strength Mg based alloy and a Mg based casting alloy having a good fluidity and a good mechanical property, and a cast article using the alloy.

As a result of various kinds of studies in order to solve the problems described above, it is found that the melting point of the alloy is lowered and the fluidity is improved by adding appropriate amounts of Al, Sn and Zn to a magnesium alloy, and the present invention is established.

The present invention is characterized by a high strength Mg based alloy, which contains 2 to 20% of Al by weight; 0.1 to 10% of Zn; 0.1 to 15% of Sn; and 0.05 to 1.5% of Mn, or preferably the remainder which is consisting essentially of Mg.

The present invention is characterized by a high strength Mg based alloy, which contains 2 to 20% of Al by weight; 0.1 to 10% of Zn; 0.1 to 15% of Sn; and 0.05 to 1.5% of Mn, and has crystal size of 10 to 300 $\mu$m, or preferably the remainder which is consisting essentially of Mg.

The present invention is characterized by a high strength Mg based alloy, which contains 8 to 20% of Al by weight; 0.1 to 5% of Zn; 0.1 to 10% of Sn; and less than 1.5% of Mn, and has a tensile strength (x) at 20° C. larger than 240 MPa; and an elongation ratio (y) larger than 0.5% and at the same time larger than a value calculated by $y=-0.295x+78$, or preferably the remainder which is consisting essentially of Mg.

The present invention is characterized by a high strength Mg based alloy, which contains 12 to 15% of Al by weight; 0.1 to 5% of Zn; 1 to 10% of Sn; 0.1 to 0.5% of Mn, and the remainder contains Mg more than 75%, or preferably the remainder which is consisting essentially of Mg.

The present invention is characterized by a high strength Mg based alloy, which contains 12 to 15% of Al by weight; 0.1 to 5% of Zn; 1 to 10% of Sn; 0.1 to 0.5% of Mn; one kind or more than two kinds of elements selected from the group consisting of Ca, Si and rear-earth elements of which the total content is less than 5%; at least one kind of element selected from the group consisting of Sr and Sb of which the total content is less than 1%; or preferably the remainder which is consisting essentially of Mg.

The present invention is characterized by a Mg based casting alloy, which contains 2 to 20% of Al by weight; and 0.1 to 15% of Sn; or preferably the remainder which is consisting essentially of Mg.

The present invention is characterized by a Mg based casting alloy, which contains 2 to 20% of Al by weight; 0.1 to 10% of Sn; and less than 1.5% of Mn, or preferably the remainder which is consisting essentially of Mg.

The present invention is characterized by a Mg based casting alloy, which contains 10 to 15% of Al by weight; 0.5 to 3% of Zn; 1.5 to 4.5% of Sn; 0.05 to 0.5% of Mn, or the remainder which is consisting essentially of Mg.

The present invention is characterized by a Mg based casting alloy which is prepared by that the above-mentioned Mg based casting alloys are added with one kind or more than two kinds of elements selected from the group consisting of Ca, Si and rear-earth elements of which the total content is less than 5% by weight; and at least one kind of element selected from the group consisting of Sr and Sb of which the total content is less than 1%, or the remainder which is consisting essentially of Mg.

The present invention is characterized by a die cast article or injection molding article, which is casted using a molten metal of any one of the alloys described above.

The present invention is characterized by a thixotropic mold article, which is molded using a molten metal of a mixture of liquid phase and solid phase of any one of the alloys described above.

In detail, it is preferable that the magnesium based alloys described above are formed in desirable shapes through die casting by injection molding.

The magnesium alloys in accordance with the present invention are improved in the fluidity due to lowering of the melting point particularly by adding a small amount of Sn to the Mg based alloy containing Al, and accordingly members having less surface defects can be obtained. Further, since low temperature molding can be performed and accordingly the contraction at solidifying is small, members having a high dimensional accuracy can be obtained. Therefore, the molding yield can be largely improved.

Further, since the load to the machines, for example, the cylinder of an injection molding machine or the like is decreased, the durable lifetime of the heat resistant materials can be lengthened.

Furthermore, the magnesium alloys in accordance with the present invention are good in mechanical property and corrosion resistance because of the homogeneous and fine microstructure.

For the purpose of solid-solution hardening, precipitation hardening and improvement of fluidity, the element Al is added above 2%, preferably above 8%, particularly preferable above 12%. However, an excessive addition exceeding 20% of the element Al produces a large grain Mg—Al intermetallic compound to substantially decrease the elongation of the molded products. Further, in the casting method having a high cooling rate such as the die casting or the injection molding, the solidified structure becomes finer as the content of Al is increased, and the Mg—Al intermetallic compound does not grow large-sized, but is finely distributed in the crystal grain boundaries. This effect becomes obvious particularly when Sn is added together. In order to make the elongation above 3.5% and the tensile strength above 265 MPa, it is preferable to add 12 to 17% of Al.

Further, the element Al in the magnesium alloy in accordance with the present invention is solved in the α-Mg phase, and reduce the melting point of the alloy. Further, the element Al is solid-solved in the α-Mg phase and crystallizes the Mg—Al intermetallic compound, with the result that the strength at room temperature of the alloy is improved. Furthermore, the element Al suppresses oxidation of the molten alloy, and improves fluidity of the molten alloy. In order to attain these effects, the Al content is above 12%, and preferably above 15%.

The element Sn is solved in the α-Mg phase, and reduce the melting point of the alloy with a small amount of nearly 0.1%, particularly more than 0.5%. Further, the element Sn is solved in the α-Mg phase and crystallizes the Mg—Sn intermetallic compound, as a result the strength at room temperature is improved. Furthermore, the effect of Sn on lowering the melting point becomes obvious particularly when Al and Zn are added together, but the effect is almost saturated when the Sn content becomes 5%. Further, when the Sn content exceeds 15%, the elongation is largely decreased, and the density of the alloy becomes large, and lose the advantage of lightness of the magnesium alloy. Particularly, the Sn content needs to be lower than 10% in order to keep the elongation above 3.5%, and the Sn content needs to be preferably lower than 8% in order to keep the elongation above 4%. When the Sn content is 1 to 7%, it is possible to obtain an alloy having both of high strength and high elongation.

The element Zn is added above 0.1% in order to improve the strength at room temperature and the castability. However, when the Zn content exceeds 10%, casting cracks are apt to occur. It is preferable that the Zn content is within a range of 0.1 to 5%, preferably 1 to 5% in which the strength is high and the casting cracks do not occur.

The element Mn improve the corrosion resistance this is because Mn forms a intermetallic compound with Al, and fix Fe in the intermetallic compound, the element Fe being contained in the alloy as an impurity deteriorate the corrosion resistance. When the Mn content exceeds 1%, the Al—Mn group intermetallic compound excessively deposited and cause an evil effect on the mechanical property, the upper limit of Mn content is set to 1%. Particularly, for the corrosion resistance, Mn content is effective above 0.05%, and preferably 0.1 to 0.5%.

The alloy in accordance with the present invention further contains at least one element selected from the group consisting of Ca, Si and rear-earth elements, the content of the one kind or in total being less than 5%; and at least one element selected from the group consisting of Sr and Sb, the content of the one kind or in total being less than 1%. The elements Ca and Si and rear-earth elements are effective to lower the melting point because these elements form eutectic groups with Mg. However, since addition of these elements deteriorates the casting property, the upper limit of the content is 5%. Particularly, it is preferable that the content is above 0.1% and the upper limit is set to 3%.

The elements Sr and Sb make the metallic structure fine, and to improve the mechanical properties. The effect of elements Sr and Sb is increased when the element Si or Ca is added together. The effect of elements Sr and Sb is increased as the content is increased, but the effect is saturated when the content exceeds 1%. Therefore, the upper limit is set to 1%. Particularly, it is preferable that the content is above 0.03%, and the upper limit is set to 0.5%.

The Mg based alloy in accordance with the present invention is characterized that the surface is covered with an oxide film which contains Mg of 15 to 35% by atoms; preferably 20 to 30%, and Mo of 5 to 20%. The Mg based alloy in accordance with the present invention is characterized that the surface is covered with an oxide film which contains Mg of 15 to 35% by atoms; Mo of 5 to 20; and metallic Al of less than 30%, preferably 10 to 25%. The Mg based alloy in accordance with the present invention is characterized that the surface is covered with an oxide film which contains Mg of 15 to 35% by atoms; Mo of 5 to 20; oxide Al of less than 15%; and metallic Al of less than 15%, preferably 4 to 12%. The Mg based alloy in accordance with the present invention is characterized that the surface is covered with an inert oxide film of which a natural immersion electric potential 30 minutes after immersing into an aqueous solution of 0.01 mol $Na_2B_4O_7$, pH 9.2, 25° C. is higher than −1500 mV, preferably higher than −1400 mV. The Mg based alloy in accordance with the present invention is characterized that the surface is covered with an oxide film of which a natural immersion electric potential 15 minutes after immersing into an aqueous solution of 0.01 mol $Na_2SO_4$, 25° C. is higher than −1500 mV, preferably higher than −1400 mV. Further, the Mg based alloy in accordance with the present invention is characterized that the surface is covered with the above-described oxide film or a specified oxide film, and a water repellent organic film containing fluoride is further coated on the oxide film.

DESCRIPTION OF THE PREFERRED EMBODIMENTS (Embodiment 1)

A magnesium chloride type flux was applied on the inner surface of a melting pot made of casting iron pre-heated in an electric furnace, and raw materials were put into the melting pot so as to form an alloy having a composition (weight %) shown in Table 1 to be melted. After stirring the molten metal at 750° C. and removing slag, the molten metal was cast in a metal mold of 50 mm×50 mm×300 mm pre-heated to 150° C. to fabricate a Mg alloy ingot. During melting work, in order to preventing burning the flux was sprinkled on the molten alloy surface, if necessary. Mm is a mischmetal (La50 wt %-Ce50 wt % alloy).

Figure 2:
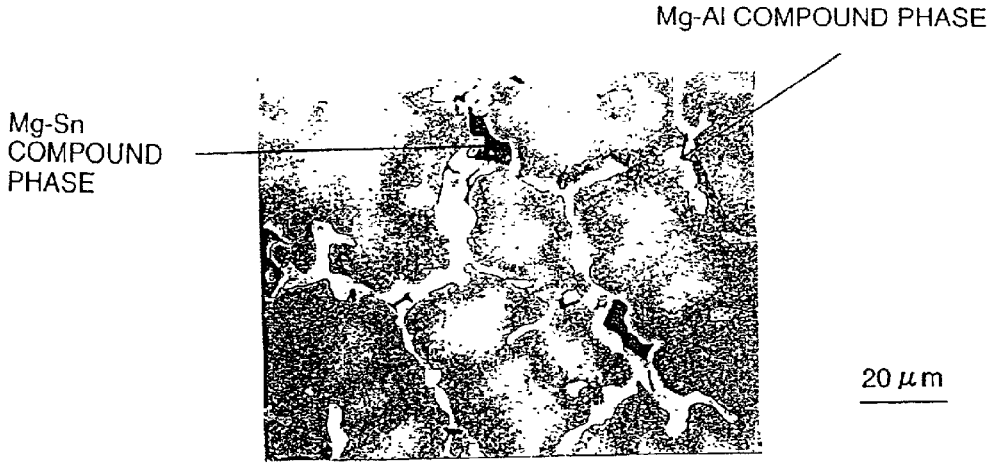
FIG. 2 is a microscopic photograph showing the metallic structure of a magnesium based alloy ingot fabricated in the embodiment 1.

FIG. 2 shows a typical metallic structure of an alloy obtained through the method as described above. Mg—Al compound phase (white portions) are crystallized in a network shape in the α-phase grain boundary, and Mg—Sn compound phase (black portions) are crystallized between the network of the Mg—Al compound phase.

Figure 3:
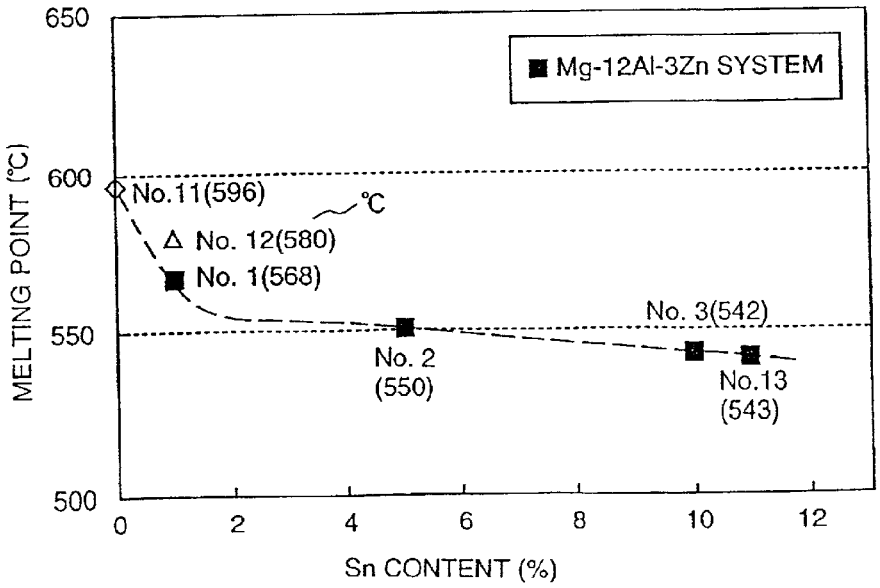
FIG. 3 is a graph showing the relationship between Sn content and melting point.

FIG. 3 shows measured results of melting points of the alloys, particularly the relationship between the melting point and Sn content for the alloys No.1 to 3 and 11 to 13. The alloy melting point is decreased as the Sn content is increased, and the effect of Sn addition on the melting point is saturated when the its content exceeds 10 Wt %. However, it can be understood that the melting point of the alloy No.12 containing Al and Zn contents less than the specified values of the present invention is small in the melting point fall from AZ91D alloy (No. 11). Further, as shown in the figure, the melting point is steeply decreased as the Sn content is increased up to the Sn content of 2%, but mildly decrease where the Sn content is above 2%. Further, by making the Sn content above 0.5%, The melting point is lower than That 596° C. of AZ91D.

(Embodiment 2)

A magnesium chloride type flux was applied on the inner surface of a melting pot made of casting iron pre-heated in an electric furnace, and raw materials were put into the melting pot so as to form an alloy having a composition (weight %) shown in Table 1 to be melted. After stirring the molten metal at 750° C. and removing slag, the molten metal was cast in a metal mold of 50 mm×50 mm×300 mm pre-heated to 150° C. to fabricate a Mg alloy ingot. During melting work, in order to preventing burning the flux was sprinkled on the molten alloy surface, if necessary. An alloy chip of 2 mm to 10 mm diameter was fabricated by milling the ingot obtained through the method as described above, and used as a raw material for injection molding. A machine having a mold clamping force of 75 t was used for the injection molding to form an injection molded piece of 120 mm×50 mm×1 mm thickness. The molding condition was as follows. A Mm (mischmetal) indicates an alloy containg 50 wt % La and 50 wt % Ce.

Injection speed: 1.6 m/s

Injection pressure: 800 kg/cm$^2$

Molten metal temperature: alloy melting point+20° C.

Mold temperature: 150° C.

Strength evaluation tests (hardness, tensile strength, elongation) were conducted by obtaining the following test pieces from the molded pieces obtained as described above.

Test piece: 1 mm thickness, 12 mm gage length, 16 mm length and 10 mm width of parallel part.

Tensile test: Using an Instron testing machine, measurement was performed under the condition of 0.3 μmin strain speed and at 25° C.

The test pieces No. 1 to 10 and 12, 13 are samples each within the composition range of the embodiment of the present invention, and the test pieces No. 11, 14 and 15 are comparative examples out of the composition range of the embodiment of the present invention (the test piece No. 11 is AZ91D standard alloy).

TABLE 1

| Alloy No. | Al | Zn | Sn | Mn | Others | Mg |
|---|---|---|---|---|---|---|
| 1 | 12 | 3 | 1 | 0.2 | — | bal. |
| 2 | 12 | 3 | 5 | 0.2 | — | bal. |
| 3 | 12 | 3 | 10 | 0.2 | — | bal. |
| 4 | 12 | 5 | 5 | 0.2 | — | bal. |
| 5 | 15 | 3 | 5 | 0.2 | — | bal. |
| 6 | 18 | 3 | 5 | 0.2 | — | bal. |
| 7 | 20 | 3 | 5 | 0.2 | — | bal. |

TABLE 1-continued

| Alloy No. | Al | Zn | Sn | Mn | Others | Mg |
|---|---|---|---|---|---|---|
| 8 | 12 | 1 | 3 | 0.2 | Si: 1, Sr: 0.05 | bal. |
| 9 | 12 | 1 | 3 | 0.2 | Ca: 2, Sb: 0.05 | bal. |
| 10 | 12 | 1 | 3 | 0.2 | Mm: 2 | bal. |
| 11 | 8.9 | 0.76 | — | 0.24 | — | bal. |
| 12 | 11 | 0 | 1 | 0.2 | — | bal. |
| 13 | 12 | 3 | 11 | 0.2 | — | bal. |
| 14 | 21 | 3 | 5 | 0.2 | — | bal. |
| 15 | 12 | 3 | 5 | — | — | bal. |

Figure 1:
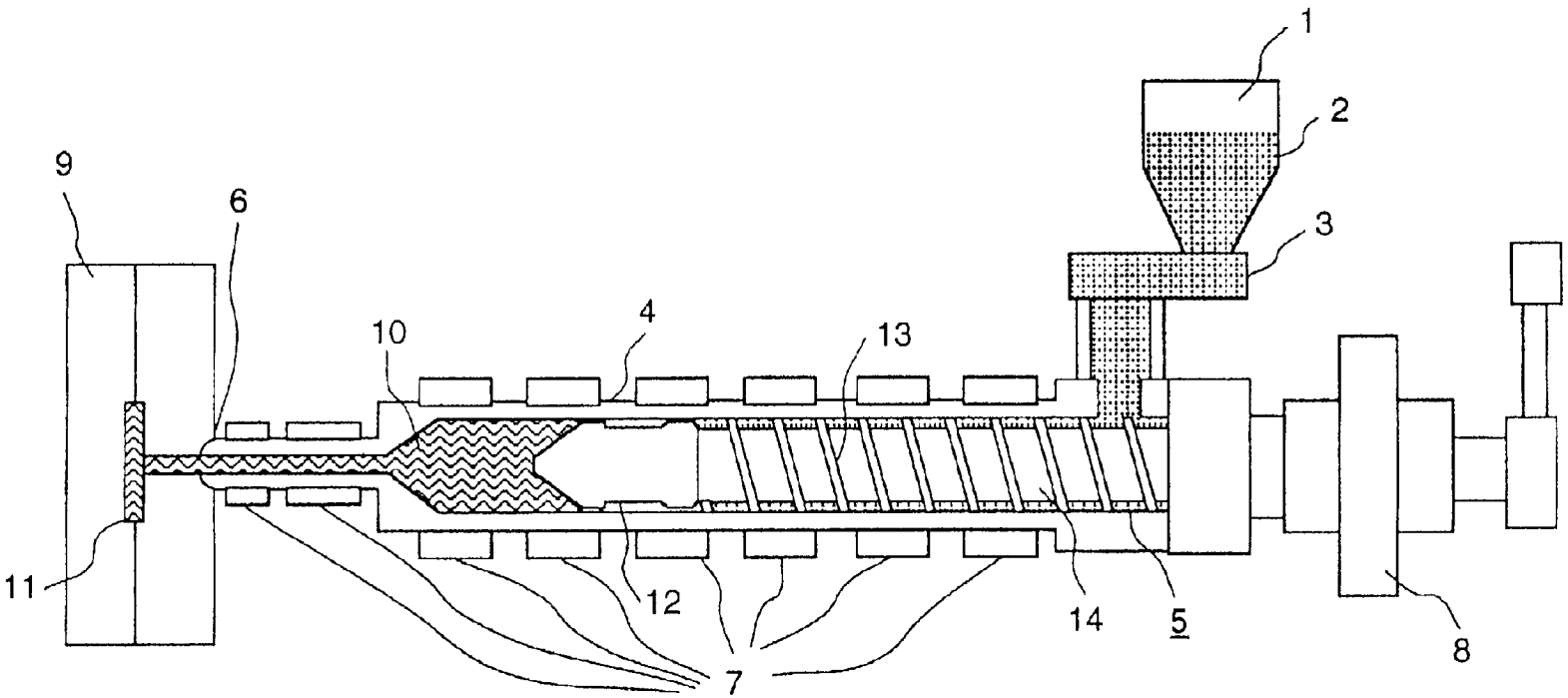
FIG. 1 is a cross-sectional view showing the construction of an injection molding machine used in the present embodiment.

FIG. 1 is a cross-sectional view showing the main portion of the injection molding machine used in the present embodiment.

An alloy raw material 1 for injection molding is put into a hopper 2 to be supplied into a cylinder 4. The raw material is kneaded and mixed in the cylinder 4 while being transferred toward a nozzle 6 by a rotating screw 5, and at the same time heated by a cylinder heater 7. The alloy raw material is injection molded under a melted state where the heated temperature is higher than the liquid-phase line temperature, or under a semi-melted state where a solid phase having a temperature lower than the liquid-phase line temperature and a liquid phase are mixed. The melted state or semi-melted state molten metal 10 of the raw alloy material transferred to the front portion of the screw 5 is filled into a metal mold 9 though the nozzle 6 by moving the screw forward using a high speed injection mechanism 8. The pressure in the metal mold is kept until the molten metal is solidified, and after being solidified the metal mold 9 is opened to take out the molded article. Referring to the figure, the screw 5 has a spiral blade 13 on a cylindrical solid based body 14, and the alloy raw material 1 is heated up to a high temperature to be made the melted state or the semi-melted state depending on the temperature of the heater 7 while being kneaded with the blade 13 by rotation of the screw 5. The reference character 12 is a backflow preventing ring for the molten metal 10.

The alloy raw material 1 used in the present embodiment is prepared by melting an alloy of each of the compositions under a non-oxidized atmosphere, and then by cutting the formed alloy into chips smaller than 10 mm to form grains of the raw material.

Figure 4:
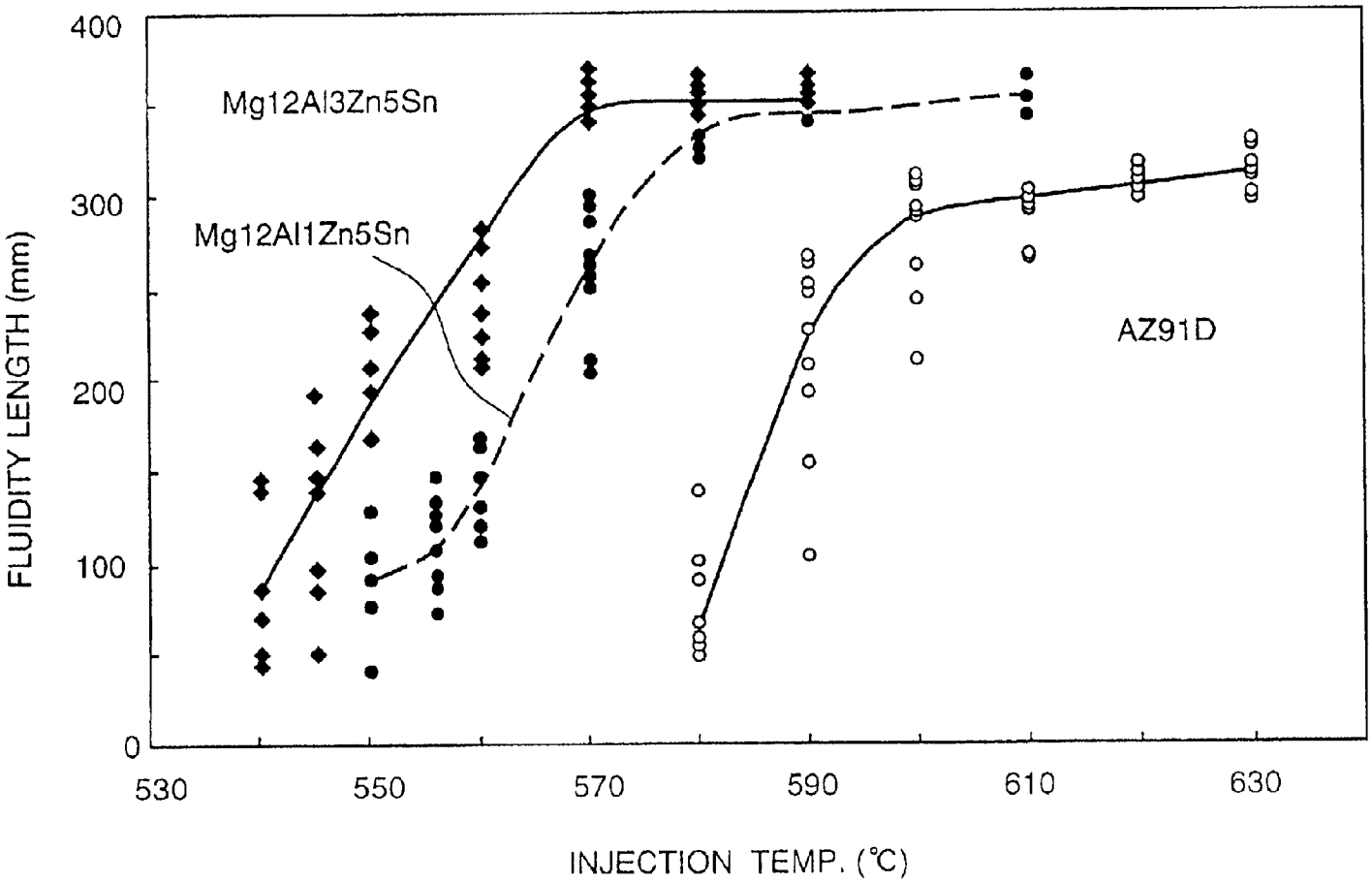
FIG. 4 is a diagram that shows the relationship between the cylinder temperature and fluidity lengths for both the magnesium-basedd alloy No.2 in the present invention and an alloy AZ91D in a prior art.

FIG. 4 is a diagram that shows the relationship between the injection temperature and fluidity lengths for both the magnesium-based alloy No. 2 in the present invention, an alloy AZ91D in a prior art. The cylinder temperature is the temperature at which alloys were molded for their fluidity length verification. The fluidity length of an alloy is the length for such sound portion in an injection-molded alloy that has no surface-defects like crack. The alloy No. 2 is a magnesium-basedd alloy containing 12% aluminum, 1% zinc, and 5% tin each in weight ratio.

The fluidity length was verified using a fluidity length verification metallic mold having a width of 10 mm, a thickness of 1 mm, and an overall length of 380 mm, into which each alloy to be verified was injection-molded by an injection molding apparatus shown in FIG. 1 keeping the verification metallic mold constantly at 200° C.

As shown in FIG. 4, it is evident that the alloy in the present invention has higher fluidity length performance than alloy AZ91D at any temperature in our investigation.

In contrast to that the fluidity lengths of alloys in a prior art reaches saturation of about 300 mm at a temperature 600° C., the alloy No. 12 in the present invention that includes 3% zinc spread its fluidity length to about 350 mm at 570° C. and another alloy in the present invention that includes 1% zinc also spreads to about 350 mm at 580° C.

Figure 5:
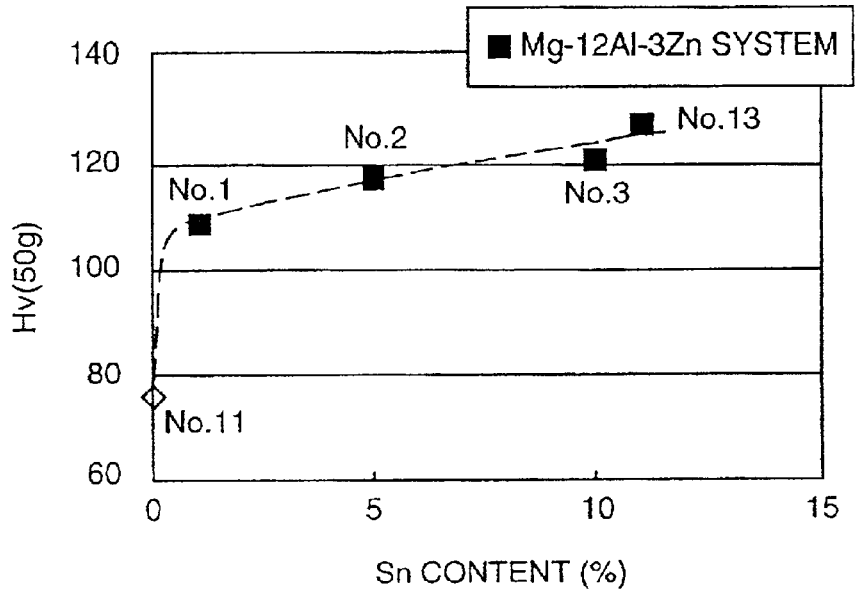
FIG. 5 is a graph showing the relationship between Sn content and Vickers hardness.
Figure 6:
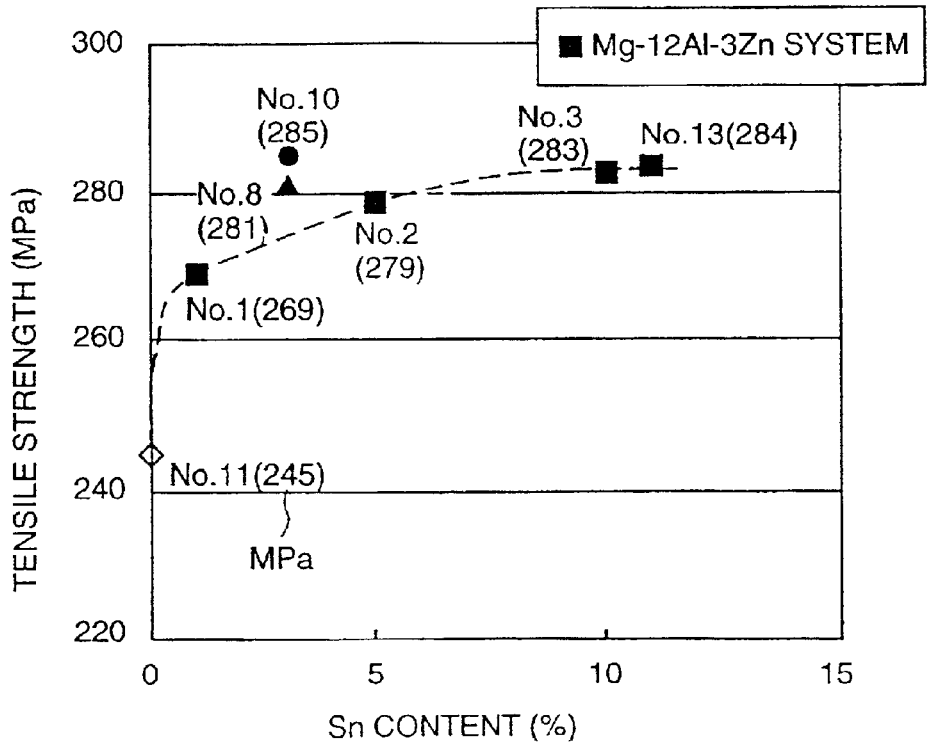
FIG. 6 is a graph showing the relationship between Sn content and tensile strength.
Figure 7:
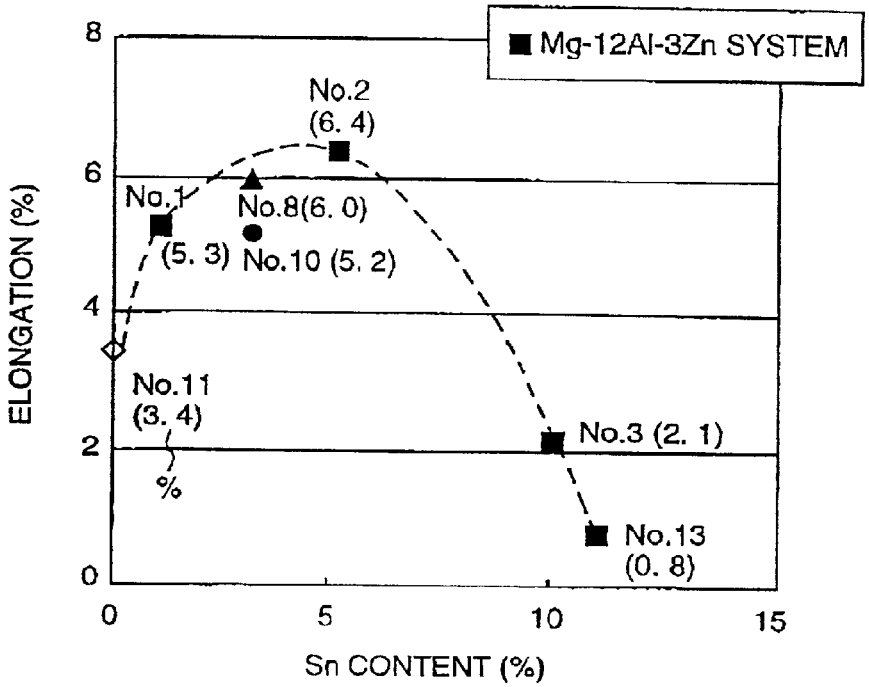
FIG. 7 is a graph showing the relationship between Sn content and elongation ratio.

FIG. 5 to FIG. 7 are graphs showing the relationships between Sn content and test results of hardness and tensile strength of the injection molded article made of each of the alloys shown in Table 1. As shown in the graphs, by adding Sn by 1%, both of the hardness and the tensile strength become above Hv 110 in hardness and above 269 MPa in tensile strength, respectively. On the other hand, the elongation ratio is improved until the Sn content is increased up to 5 wt %, but is decreased when the Sn content exceeds 5%, and is steeply decreased to a value before adding Sn when the Sn content exceeds 9%.

Figure 8:
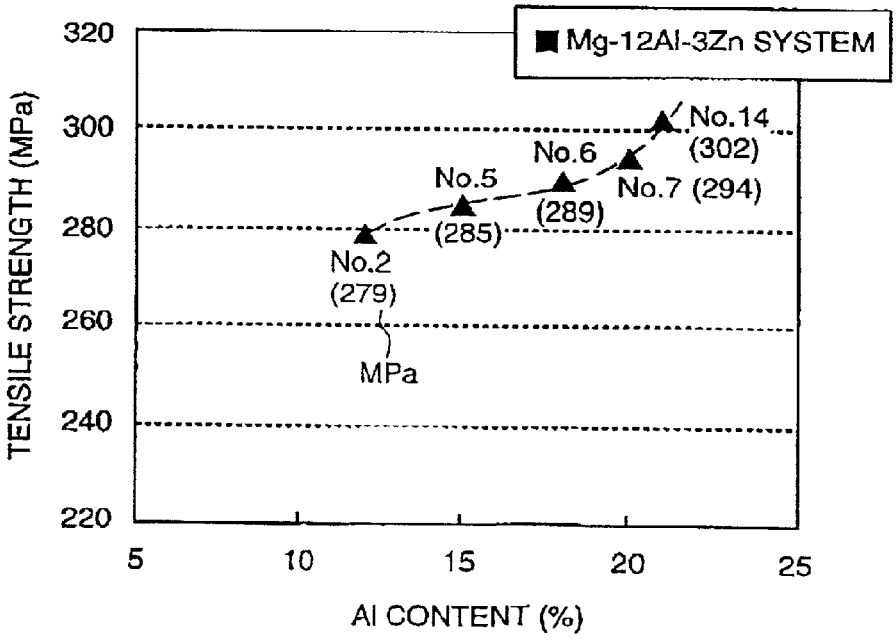
FIG. 8 is a graph showing the relationship between Al content and tensile strength.
Figure 9:
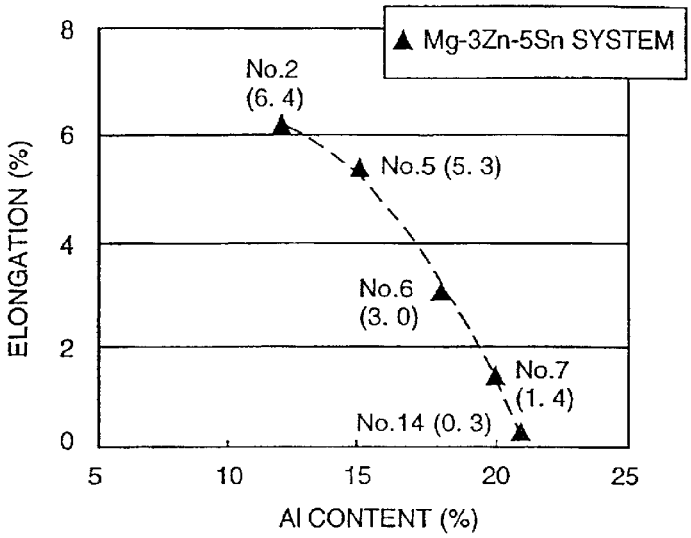
FIG. 9 is a graph showing the relationship between Al content and elongation.

FIG. 8 and FIG. 9 are graphs showing results of tensile test when the Al content is varied on the basis of the alloy No. 2 (Mg-12Al-3Zn-5Sn). As shown in the graphs, the tensile strength is improved with increasing the Al content, and the tensile above 279 MPa can be obtained up to 12% of Al content. In regard to the elongation ratio, the elongation ratio above 1.9% can be obtained up to 20% of Al content. However, when the Al content exceeds 20%, the elongation ratio is extremely decreased to a value smaller than 1%, which is impractical.

As the contents of Al, Zn, Sn in the magnesium alloy are increased, (Mg—Al group, Mg—Sn group) crystallized in the α-phase grain boundaries are increased. Increase in the amount of the generally causes to lower the elongation. However, addition of Al, Zn, Sn also has an effect to fine the α-phase, and accordingly the relative ratio of the α-phase grain boundary volume to the intermetallic compound amount is not largely changed even if the amount of the intermetallic compound is increased. Therefore, it can be considered that large decrease of elongation can be suppressed. However, it is considered that the fining effect is saturated and the elongation is steeply decreased at values near the Sn and Al contents of 10 wt % and 20 wt %, respectively.

Figure 10:
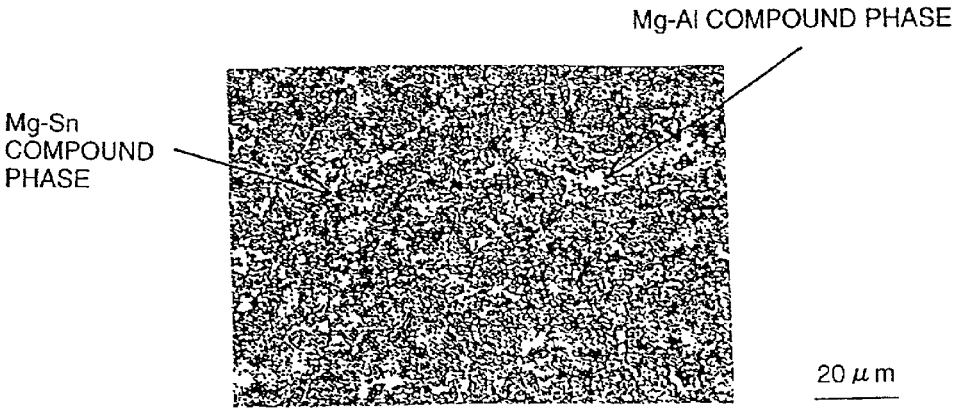
FIG. 10 is a SEM photograph showing the metallic structure of a magnesium based alloy ingot fabricated in the embodiment 2.

FIG. 10 shows the photograph of the structure of the injection molded article made of the alloy No.2. The α-phase grains having size of nearly 1 to 20 μm, mainly less than 5 μm and the Mg—Al compound phase crystallized in network shape in the grain boundaries are observed. White small nodules are the Mg—Sn compound phase, and it can be understood from this photograph that the solidification structure is refined, and the Mg—Al and the Mg—Sn compound phase are uniformly distributed.

In the case where among the magnesium alloys described above, the embodiments of the alloys No. 1 to 3 in accordance with the present invention are injection molded by setting the molten alloy temperature to the same value (620° C.), surface defects of the molded articles of the alloys No. 1 to 3 are substantially decreased compared to those of the molded article of AZ91D alloy. The reason is that the difference between the molten alloy temperature and the melting point becomes larger by the amount of decreasing the melting point, and accordingly the fluidity is improved.

Further, in the case where molding was performed by setting the molten alloy temperature at injection molding to a temperature lower than the melting point of the alloy by 10° C., that is, in the case where injection molding was performed under the semi-solid state that the solid phase and the liquid phase were mixed, the dimensional accuracy of the molded article made of each of the alloys was better than that of AZ91D alloy.

Figure 11:
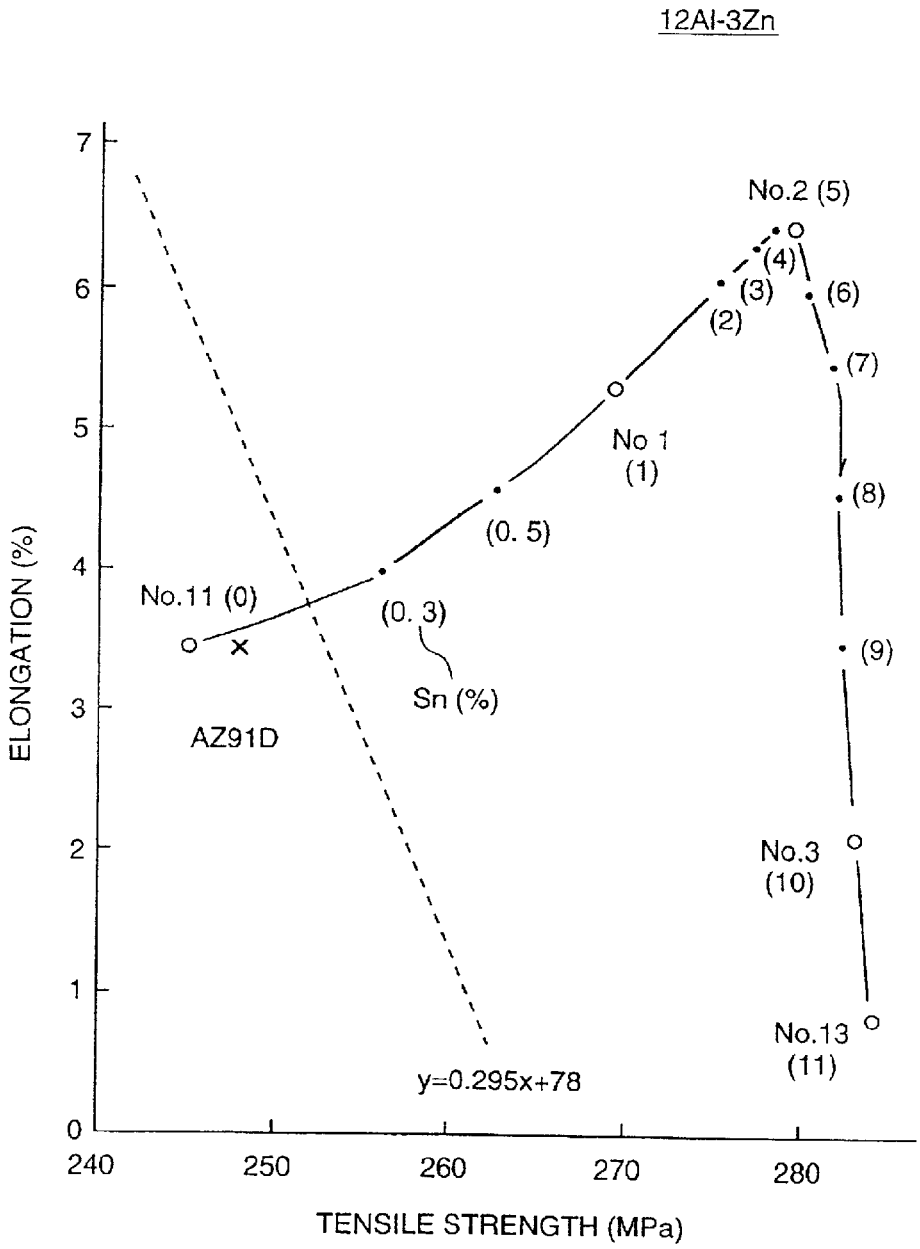
FIG. 11 is a graph showing the relationship between elongation and tensile strength.

FIG. 11 is a graph showing the relationship between tensile strength and elongation of the Mg based alloy when the Sn content is varied to the 12% Al-3% Zn alloy. As shown in the graph, although the strength and the elongation are increased up to the Sn content of 5%, the strength is increased but the elongation is decreased when the Sn content exceeds 5%. However, the elongation is as high as 0.5% even at the Sn content of 11%.

The straight line in the graph is expressed by the elongation (%) (y) and the tensile strength (MPa) (x), the present embodiment has the elongation higher than the value calculated by y=−0.295x+78. Further, it is preferable that the tensile strength and the elongation are higher than values calculated by the relationships y=−0.295x+82, 85 or 87.

Figure 12:
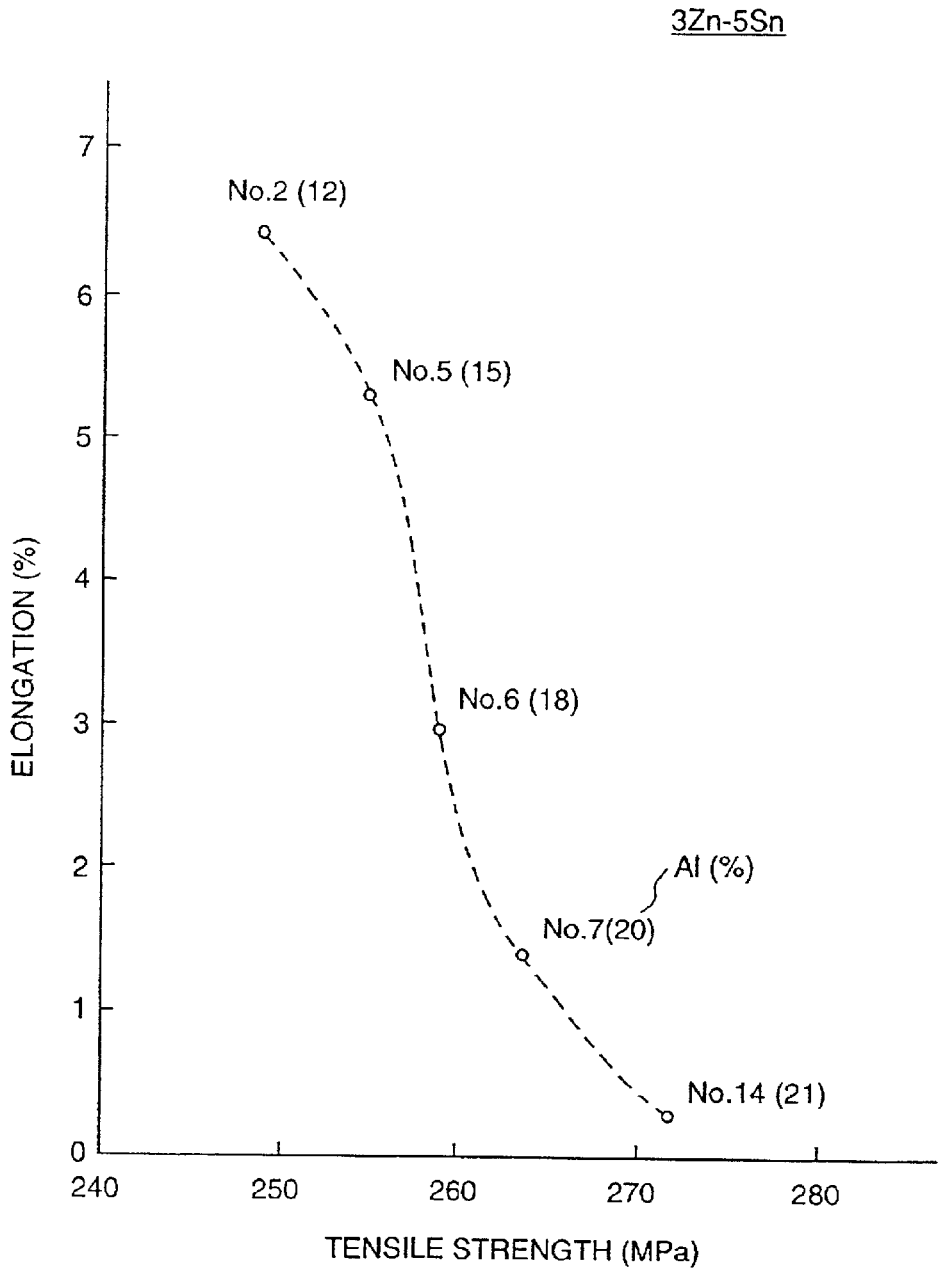
FIG. 12 is a graph showing the relationship between elongation and tensile strength.

FIG. 12 is a graph showing the relationship between tensile strength and elongation of the Mg based alloy when the Al content is varied to the 3% Zn-5% Sn alloy. As shown in the graph, it can be understood that the tensile strength having a value higher than 275 MPa can be obtained by increasing the Al content to 12%, and the elongation having a value higher than 0.5% can be also obtained when the Al content is less than 20.5%. It is also preferable that in this graph, the values are set higher than the values calculated by the above-described relationship expressed by the elongation ratio (y) and the tensile strength (x).

Figure 13:
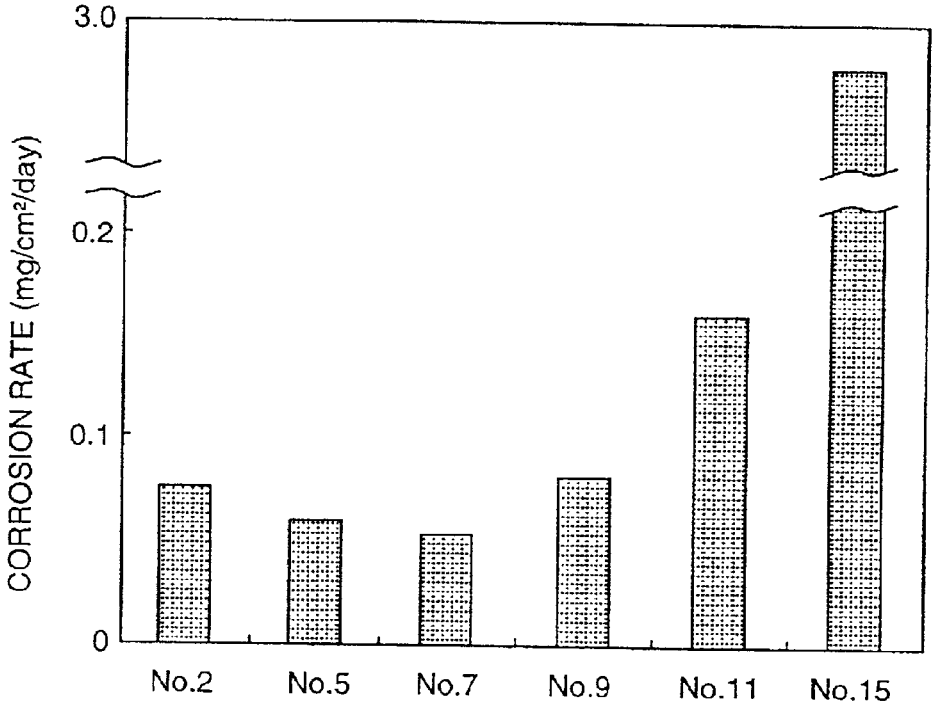
FIG. 13 is a graph showing the salt spray test result for varous Mg based alloys.

FIG. 13 is a graph showing the corrosion rate of injection molded articles made of the present embodiments of alloys No. 2, 5, 6, 7 and the comparative alloys No. 11, 15 by a salt water spray test (splaying 5% NaCl aqueous solution for 360 hours) at 20° C. From the graph, it can be understood that all the alloys of the present embodiment have better corrosion resistance below corrosion mass loss of 0.1 ($mg/cm^2 \cdot day$) compared to that of AZ91D alloy (No. 11). Further, it can be also understood that the corrosion resistance is more improved as the Al content is higher. Further, as it is clear from the fact that the alloy No.2 added with Mn shows better corrosion resistance compared to that of the comparative alloy No. 15 not added with Mn, addition of a very small amount of Mn substantially increase the corrosion resistance. Further, as shown by the alloys No. 5 and 7, it can be understood that high corrosion resistance can be obtained by increasing the Al content.

(Embodiment 3)

Figure 14A:
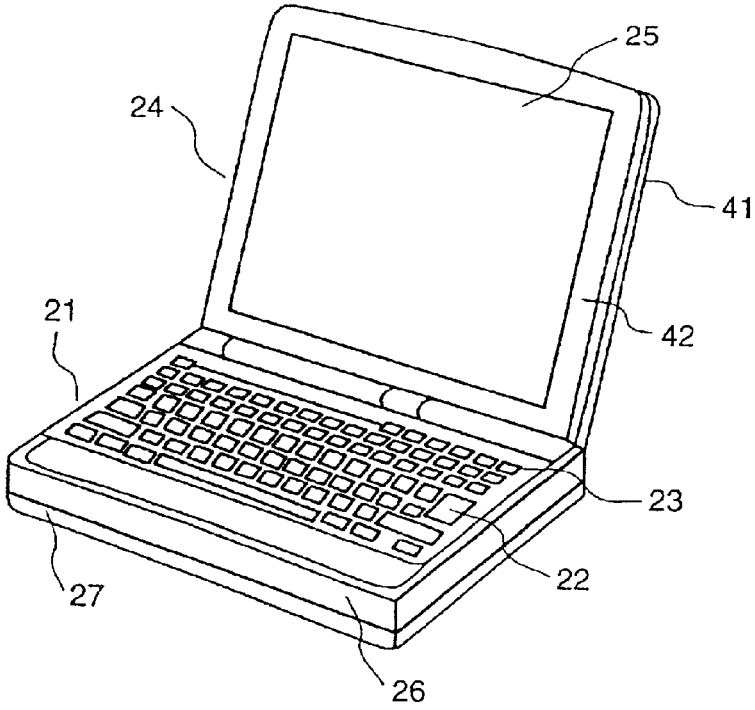
FIG. 14 is a perspective view showing a note-shaped personal computer.
Figure 14B:
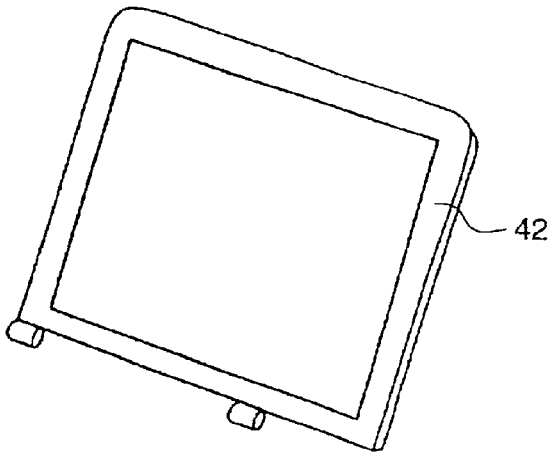

FIG. 14 is a perspective view showing a notebock-size personal computer. In a main body 21, there are arranged a keyboard 22 for operating input means and a switch board unit 23 containing light-emitting diodes (LEDs) for indicators and a main switch. The exterior of the main body 21 is composed of a main body upper case 26 and main body bottom case 27. The exterior of a display portion 24 is composed of a liquid crystal display (LCD) case 41 and an LCD front 42. In the LCD front 42, a display window is opened so that the display portion of the liquid crystal screen 25.

Among these components, the LCD front 42 was molded using the alloy No. 2 by an injection molding machine of 650 t mold clamping force in order to make the weight light and to improve the stiffness and the heat dissipation. The injection speed was 3 m/sec, molten alloy temperature was 580° C. and metal mold temperature was 200° C. The dimension of the molded article was 230 mm×180 mm×4 mm, and average thickness of 0.7 mm. The molded article obtained through such a way could be formed in a good dimensional accuracy without surface defects and with good yield. Similarly, the bottom case was fabricated.

(Embodiment 4)

Figure 15A:
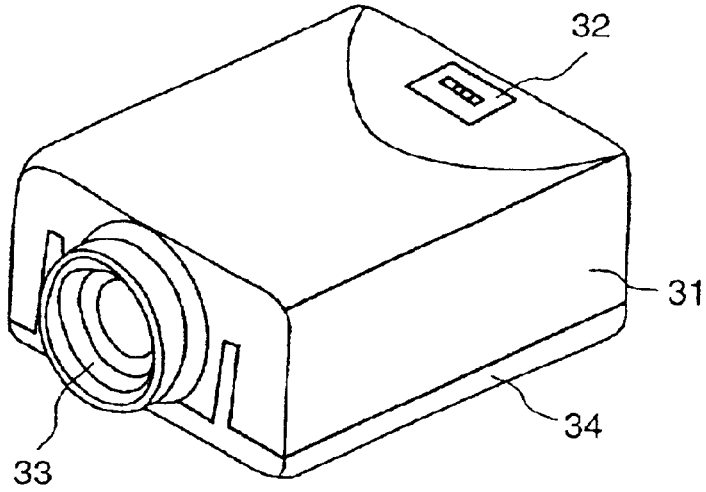
FIG. 15 is a perspective view showing a mobile type liquid crystal projector.
Figure 15B:
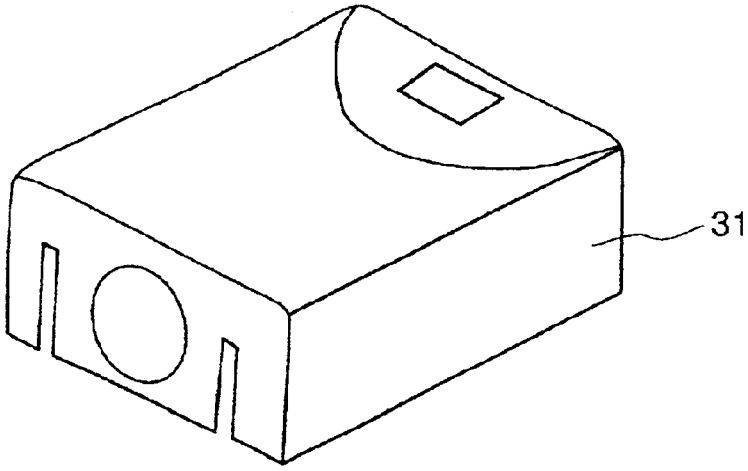

FIG. 15 is a perspective view showing a mobile type liquid crystal projector.

A main body is composed of a switch board unit 32 containing LEDs for indicators and a main switch and a projection lens 33, and the exterior is composed of a main body upper case 31 and a main body bottom case 34.

Among these components, the main body upper case 31 was casted using the alloy No. 2 by a hot chamber die-cast machine of 600 t mold clamping force. The molding condition was injection speed of 2.5 m/sec, molten alloy temperature of 600° C. and metal mold temperature of 200° C. The dimension of the molded article was 248 mm×330 mm×100 mm, and average thickness of 1.5 mm. Even though the component was comparatively large, a good molded article could be formed without filling defects in a thin wall portion nor occurrence of surface defects (Embodiment 5)

Figure 16:
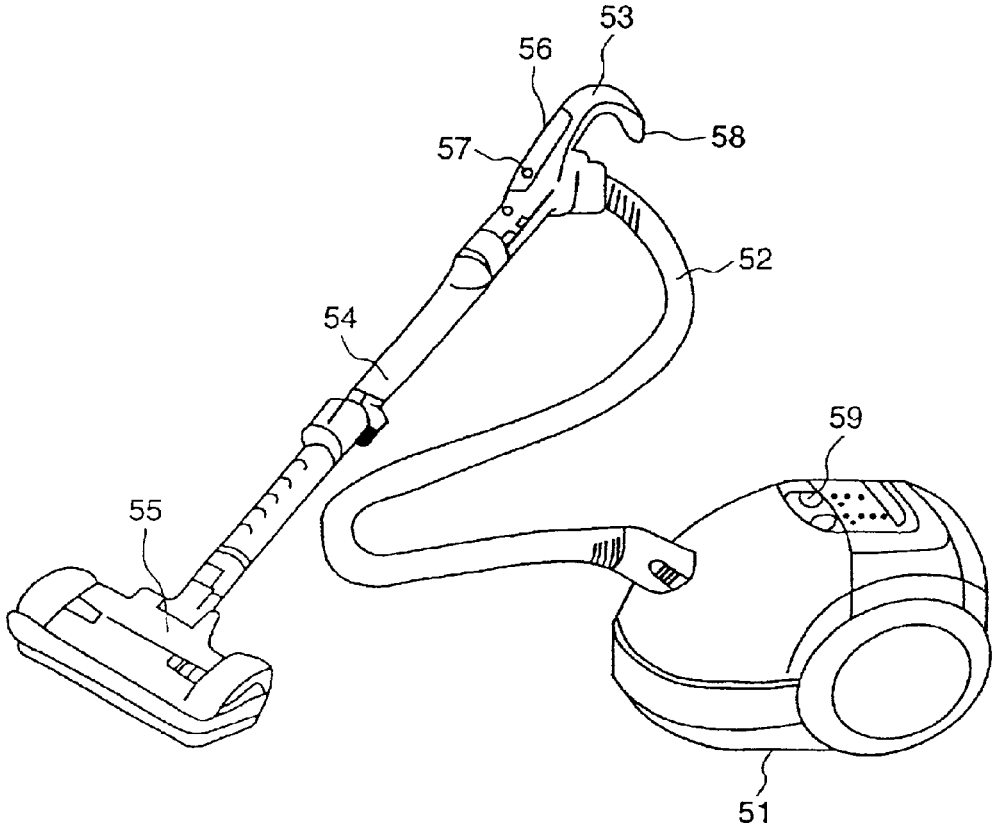
FIG. 16 is a perspective view showing a home electric vacuum cleaner.

FIG. 16 is a perspective view showing a home electric vacuum cleaner having an impeller using the Mg based alloy in accordance with the present invention. Referring to FIG. 16, the reference character 51 is a vacuum cleaner main body which contains a control circuit and an electric drive fan and so on, the reference character 52 is a hose connected to a suction nozzle portion of the vacuum cleaner main body 51, the reference character 53 is a hose grip portion, the reference character 54 is an extension pipe connected to an end (the hose grip portion 53) of the hose, the reference character 55 is a nozzle body connected to the extension pipe 54, the reference character 56 is a switch operating portion arranged in the hose grip portion 53, the reference character 57 is a first infrared light emitting portion arranged in the hose grip portion 53, the reference character 58 is a second infrared light emitting portion arranged in the hose grip portion 53, and the reference character 59 is an infrared light receiving portion arranged on the upper surface of the vacuum cleaner main body.

Figure 17:
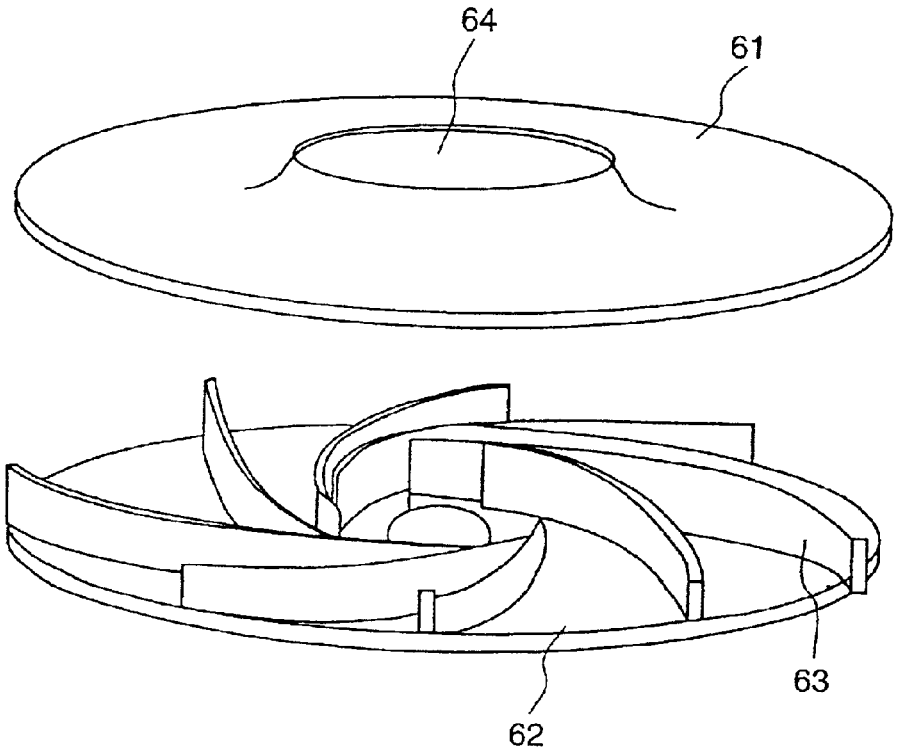
FIG. 17 is a perspective view showing an impeller.

FIG. 17 is an exploded perspective view showing the impeller.

As a molding method of integrating a front plate 61, a rear plate 62 and blades 63 in one piece, an injection molding method was employed in the present embodiment. In this method, a light metal raw material formed in pellets is used similarly to the injection molding method, and kneaded and melted directly inside an injection molding machine without using any melting furnace or the like, and injected into a metal mold to obtain a molded article. In the present embodiment, the front plate 61, the rear plate 62 and the blades 63 integrated in one piece are individually formed in one piece using the magnesium based alloy shown in Embodiment 1. Solder material layers are provided over all the surfaces of the front plate 61 and the rear plate 62, and the blades 63 are joined with the solder material. The reference character 64 is a suction port. In the present embodiment, the impeller can be obtained by a mixed molten alloy of liquid phase and solid phase using the injection molding machine shown in FIG. 1.

According to the present embodiment, the impeller can be made light in weight without filling defects even though the wall thickness is as thin as 0.7 mm, and the air flow resistance can be reduced. Therefore, the rotating speed of 45000 to 50000 rpm can be attained at 1 kW consumed electric power, and the suction power can be attained above 550 W.

(Embodiment 6)

Figure 18:
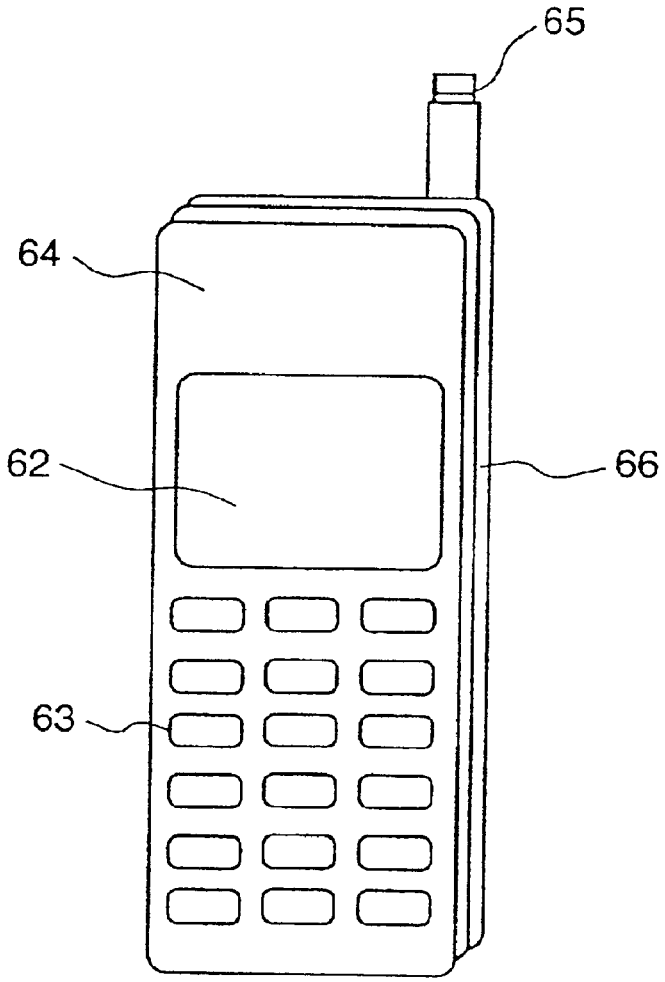
FIG. 18 shows a perspective view of a portable telephone apparatus to which a magnesium-basedd alloy disclosed in the embodiment 1 in the present invention is applied.

FIG. 18 shows a perspective view of a portable telephone apparatus to which a magnesium-basedd alloy disclosed in the embodiment 1 in the present invention is applied. As illustrated in FIG. 18, the apparatus is comprised of a cover (4) that includes a number display part (2) and a plurality of keys (3), a retractable antenna (5), and a case (6).

Among these parts, the cover (4) and the case (6) were injection-molded out of the alloy No.2 for reduce weight, and improving stiffness, heat dissipation, and electromagnetic shielding properties using an injection molding apparatus having mold clamping force of 75 ton. The injection speed was 1 m/s and the temperature of the molten metal was 580° C. The dimensions of the molded product were 125 mm by 38 mm by 8 mm and average wall thickness was 0.5 mm. This alloy has not caused any filling-defect and surface-defect with acceptable yield in molding process even in a thin wall product like this embodiment.

(Embodiment 7)

A front cabinet of a 21-inch type television set, a steering wheel core of a vehicle, a case body of a video-camera, a rid of an MD player and a case body of a compact camera are manufactured by a mixed molten alloy of liquid phase and solid phase using the injection molding machine shown in FIG. 1. In these cases, good molding crystals can be obtained without filling defects even though the wall thickness is as thin as 0.7 mm.

(Embodiment 8)

Oxide films having 0.1 to 3 $\mu$m were formed on the surfaces of the various kinds of the products described in Embodiments 3 to 6 using the Mg based alloys in accordance with the present invention by immersing the products into aqueous solutions of 1M-$Na_2MoO_4$ and 1M-$Na_2SO_4$-0.5M.NaF (adjusting to pH 3.0 with $H_2SO_4$) at 60° C. for 180 seconds, respectively. The surface of the product is colored, and the thickness of the film can be estimated from the tone of the color. The color is changed from light brown to dark blown, and further to black depending on the processing time. The obtained film showed good corrosion resistance, and had such an inert electric potential that the natural immersion electric potential 30 minutes after immersing into an aqueous solution of 0.01M-$Na_2B_4O_7$ (pH 9.18) was higher than −1500 mv. Further, the oxide film was suitable as a based for coating with paint.

A water repellent fluoride film was further coated on the oxide film by being immersed into a solution dissolving perfluoro-hexane for 24 hours and then by being heated at 150° C. for 10 minutes. The organic film had such a high water repellence that the contact angle with water was 120 to 130 degrees, and accordingly the durability could be further improved.

According to the present invention, it is possible to obtain an Mg based alloy which is low in melting point, good in fluidity at molding, and good in mechanical property due to uniform and fine structure. Further, by reducing number of surface defects by improving the fluidity and by improving the dimensional accuracy by low temperature molding, the molding yield can be substantially improved. Furthermore, by reducing load to the metal members and the heat resistant members such as the mold and the cylinder of the injection molding machine, the lifetime of these members can be extended, and accordingly the production efficiency of the magnesium based alloy parts can be improved.

In addition, according to the present invention, by forming the oxide film containing heavy metals having plural valences and enriched with Al in the based material on the surface of the Al containing Mg alloy through process in the solution, the oxide film can serve as a paint based having good corrosion resistance. Further, the film described above can be fabricated without using any material harmful for the environment.

By applying a general corrosion preventive paint or a water repellent paint onto the film, a better corrosion preventive coating film can be obtained.

What is claimed is:

1. A high strength Mg based casting alloy, which is injection molded using a metal mold, and which contains, by weight, more than 10%, and up to 17%, of Al; 0.1 to 10% of Zn; 1 to 10%, of Sn; and 0.05 to 1.5% of Mn, whose surface is covered with an oxide film which contains Mg of 15 to 35% by atoms.

2. A high strength Mg based casting alloy according to claim 1, wherein said oxide film further includes an oxide of Al of less than 15% by atoms.

3. A high strength Mg based casting alloy, which is injection molded using a metal mold, and which contains, by weight, more than 10%, and up to 17%, of Al; 0.1 to 10% of Zn; 1 to 10%, of Sn; and 0.05 to 1.5% of Mn, whose surface is covered with an inert oxide film having a natural immersion electric potential, 30 minutes after immersing into an aqueous solution of 0.01 mol $Na_2B_4O_7$, pH of 9.2 and a temperature of 25° C., which is greater than −1500 mV.

4. A high strength Mg based casting alloy, which is injection molded using a metal mold, and which contains, by weight, 12 to 15% of Al; 0.1 to 5% of Zn; 1 to 10% of Sn; 0.1 to 0.5% of Mn; at least one element selected from the group consisting of Ca, Si and rare-earth elements of which the total content is less than 5%; at least one kind of element selected from the group consisting of Sr and Sb of which the total content is less than 1%; and the remainder which is consisting essentially of Mg, whose surface is covered with an oxide film which contains Mg of 15 to 35% by atoms.

5. A high strength Mg based casting alloy, which is injection molded using a metal mold, and which contains, by weight, 12 to 20% of Al; and 1 to 10%, of Sn, whose surface is covered with an oxide film which contains Mg of 15 to 35% by atoms.

6. A high strength Mg based casting alloy, which is injection molded using a metal mold, and which contains, by weight, 2 to 20% of Al; 1 to 10%, of Sn; and less than 1.5% of Mn, whose surface is covered with an oxide film which contains Mg of 15 to 35% by atoms.

7. A high strength Mg based casting alloy, which is injection molded using a metal mold, and which contains, by weight, 12 to 15% of Al; 0.1 to 5% of Zn; 1 to 10% of Sn; 0.1 to 0.5% of Mn; at least one element selected from the group consisting of Ca, Si and rare-earth elements of which the total content is less than 5%; at least one kind of element selected from the group consisting of Sr and Sb of which the total content is less than 1%; and the remainder which is consisting essentially of Mg, whose surface is covered with an inert oxide film having a natural immersion electric potential, 30 minutes after immersing into an aqueous solution of 0.01 mol $Na_2B_4O_7$, pH of 9.2 and a temperature of 25° C., which is greater than -1500 mV.

8. A high strength Mg based casting alloy, which is injection molded using a metal mold, and which contains, by weight, 12 to 20% of Al; and 1 to 10%, of Sn, whose surface is covered with an inert oxide film having a natural immersion electric potential, 30 minutes after immersing into an aqueous solution of 0.01 mol $Na_2B_4O_7$, pH of 9.2 and a temperature of 25° C., which is greater than -1500 mV.

9. A high strength Mg based casting alloy, which is injection molded using a metal mold, and which contains, by weight, 2 to 20% of Al; 1 to 10%, of Sn; and less than 1.5% of Mn, whose surface is covered with an inert oxide film having a natural immersion electric potential, 30 minutes after immersing into an aqueous solution of 0.01 mol $Na_2B_4O_7$, pH of 9.2 and a temperature of 25° C., which is greater than −1500 mV.

* * * * *